US005890245A

United States Patent [19]

Klearman et al.

[11] Patent Number: 5,890,245

[45] Date of Patent: Apr. 6, 1999

[54] DISPOSABLE VENTILATING MATTRESS AND METHOD OF MAKING SAME

[75] Inventors: Jeffrey Klearman; Robert T. Bronson, both of St. Louis; Jerry M. Roth, House Springs, all of Mo.

[73] Assignee: Therapy Concepts, Inc., St. Louis, Mo.

[21] Appl. No.: 743,967

[22] Filed: Nov. 5, 1996

[51] Int. Cl.[6] ..... A61G 7/057; A47C 27/10

[52] U.S. Cl. ..... 5/714; 5/710

[58] Field of Search ..... 5/710, 711, 712, 5/713, 714, 932

[56] References Cited

U.S. PATENT DOCUMENTS

| | | | |
|---|---|---|---|
| 2,318,492 | 11/1943 | Johnson | 5/712 |
| 2,703,770 | 3/1955 | Melzer | 5/710 |
| 2,748,401 | 9/1956 | Winstead | 5/711 |
| 4,225,989 | 10/1980 | Corcbett et al. | 5/714 X |
| 4,391,009 | 7/1983 | Schild et al. | 5/714 X |
| 4,613,767 | 9/1986 | Carr et al. | 5/714 |
| 5,022,109 | 6/1991 | Pekar | 5/710 |
| 5,044,030 | 9/1991 | Balaton | 5/710 |

*Primary Examiner*—Michael F. Trettel
*Attorney, Agent, or Firm*—Howell & Haferkamp, L.C.

[57] ABSTRACT

An inflatable mattress comprises superposed lower, middle, and upper sheet layers. The lower and middle sheet layers are joined to each other in a manner to define an inflatable air chamber. The middle and upper sheet layers are secured to each other in a manner to define at least two independently inflatable mattress portions. Fluid passageways provide fluid communication between the air chamber and the inflatable mattress portions. A plurality of ventilation apertures are through the upper sheet layer for ventilating air from the inflatable mattress portions. The sheet layers are arranged such that air introduced into the inflatable air chamber flows through the fluid passageways into the inflatable mattress portions and then out through the ventilation apertures.

14 Claims, 4 Drawing Sheets

DISPOSABLE VENTILATING MATTRESS AND METHOD OF MAKING SAME

BACKGROUND OF THE INVENTION

This invention relates generally to ventilating air mattresses and to methods of making air mattresses.

People confined to bed for extended periods often experience ulcerations of the skin (e.g., bed sores). These skin ulcerations form when a patient's weight is not evenly distributed on the bed. In particular, the uneven weight distribution on the bed causes localized pressures (i.e., pressure points) which result in a compression of capillaries in the skin and thereby a restriction in blood flow. This restriction in blood flow may cause discomfort to the patient and may induce bed sores.

Therapeutic low air loss or ventilating mattresses have been developed to accommodate patients who are likely to be bedridden for extended periods. A conventional ventilating mattress has many perforations through its support surface through which pressurized air is forced at a controlled rate. These mattresses evenly distribute the weight of the patient to reduce localized pressures. This feature decreases the likelihood that any particular portion of the patient's body will be subjected to sufficient pressure to impede blood flow to skin tissue. Ventilating mattresses therefore decrease the possibility that patients will develop skin ulcerations.

Conventional ventilating mattresses are often formed with a plurality of inflatable mattress sections (e.g., a head section, a torso section, and a leg section) which may be inflated to different pressures. Such mattresses generally have tubes or conduits extending from a source of pressurized air to the mattress sections.

A disadvantage of conventional ventilating mattresses is that they are generally relatively expensive to make. Because of their expense, hospitals usually reuse them, necessitating that they be sanitized between patients to avoid cross-contamination.

SUMMARY OF THE INVENTION

Among the several objects and features of the present invention may be noted the provision of an improved ventilation air mattress; the provision of such a mattress which includes a plurality of inflatable mattress sections which may be inflated to different pressures without the need for tubes or external conduits; the provision of such a mattress which has a minimum number of component parts; the provision of such a mattress which is made of a minimum number of materials; the provision of such a mattress which is of a simple and inexpensive construction; the provision of an improved method of making an air mattress; the provision of such a method which minimizes the labor required to make the mattress; and the provision of such a method which is simple and relatively easy to employ.

In general, an inflatable mattress of the present invention comprises superposed lower, middle, and upper sheet layers. The lower and middle sheet layers are joined to each other in a manner to define an inflatable air chamber. The middle and upper sheet layers are secured to each other in a manner to define at least two independently inflatable mattress portions. Fluid passageways provide fluid communication between the air chamber and the inflatable mattress portions. A plurality of ventilation apertures are through the upper sheet layer for ventilating air from the inflatable mattress portions. The sheet layers are arranged such that air introduced into the inflatable air chamber flows through the fluid passageways into the inflatable mattress portions and then out through the ventilation apertures.

Another aspect of the present invention is a method of making an inflatable mattress. The mattress includes upper, middle, and lower sheet layers with each sheet layer having opposite upper and lower faces. The middle and lower sheets are joined together in a manner to define an inflatable air chamber. The upper and middle sheets are joined together in a manner to define at least one inflatable mattress portion. The method comprises positioning the upper, middle, and lower sheet layers in a generally face-to-face orientation so that the lower face of the upper sheet layer faces the upper face of the middle sheet layer and the lower face of the middle sheet layer faces the upper face of the lower sheet layer. First regions of the middle and lower sheets are squeezed together between first and second press elements, the first press element being in contact with the upper face of the middle sheet layer and the second press element being in contact with the lower face of the lower sheet layer. The first regions of the middle and lower sheets are heat sealed together as the first regions are squeezed together. Second regions of the upper and middle sheets are squeezed together between third and fourth press elements, the third press element being in contact with the upper face of the upper sheet layer and the fourth press element being in contact with the lower face of the middle sheet layer. The second regions of the upper and middle sheets are heat sealed together as the second regions are squeezed together.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
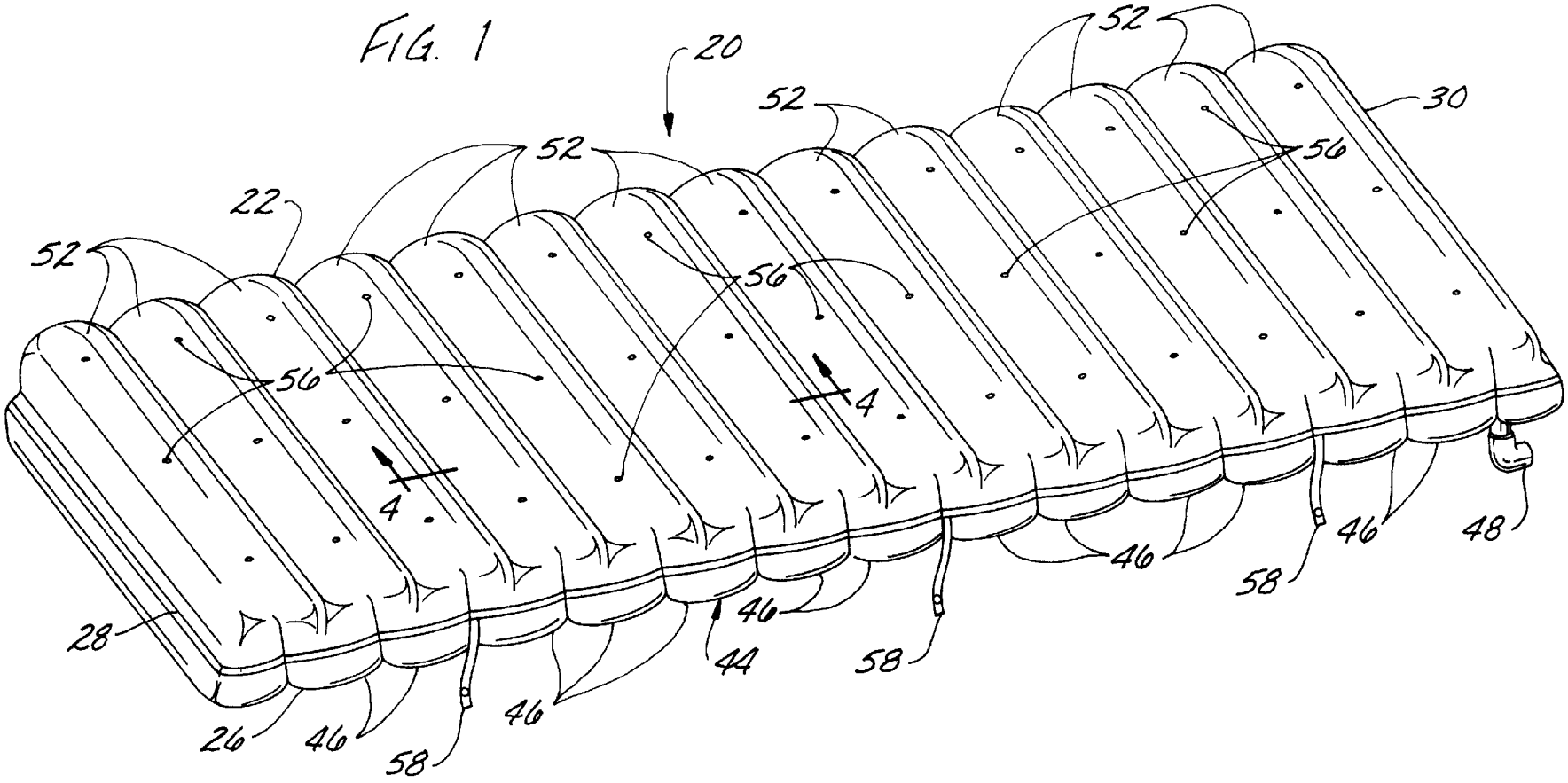
FIG. 1 is a perspective view of an inflatable mattress of the present invention, the mattress being in an inflated condition.

Referring now to the drawings, and first more particularly to FIGS. 1–4, an inflatable mattress of the present invention is indicated in its entirety by the reference numeral 20. The mattress 20 is configured for supporting a person (not shown) lying thereon. It comprises superposed (i.e., face-to-face) upper, middle, and lower sheet layers 22, 24, 26. The sheet layers are of a low-cost, heat-sealable polymeric sheet material, preferably having a thickness of approximately 8 mills. Preferably, the sheet material is a film comprising polyethylene with an 18% EVA additive. However, it is to be understood that other materials may be used without departing from the scope of this invention. The sheet layers 22, 24, 26 are generally elongate sheets each having a head end edge at the head end 28 of the mattress 20 (i.e., the left-most end as viewed in FIGS. 2 and 3), a foot end edge at the foot end 30 of the mattress (i.e., the right-most end as viewed in FIGS. 2 and 3), and side edges.

Figure 2:
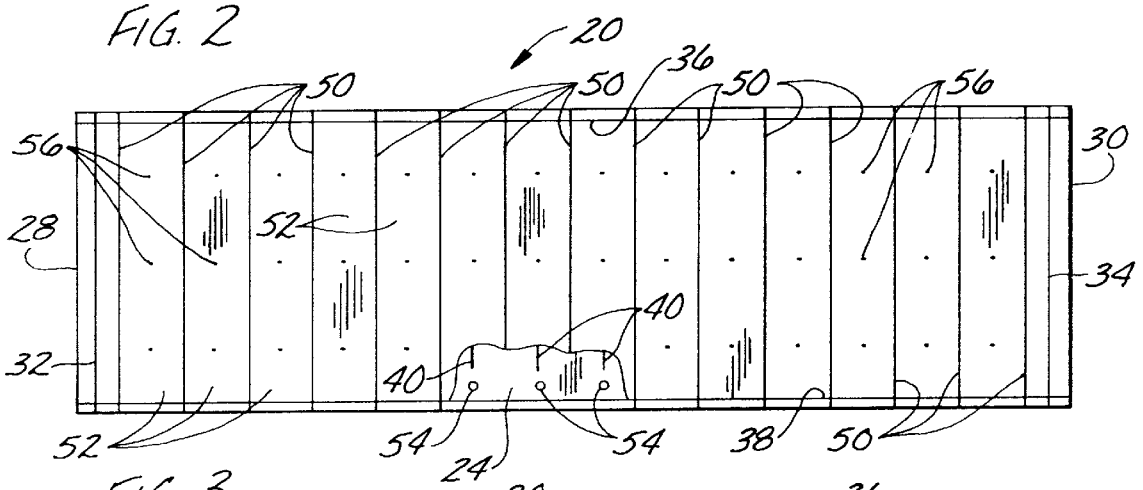
FIG. 2 is top plan view of the mattress of FIG. 1 with portions broken away to show detail, the mattress being in a deflated condition.
Figure 3:
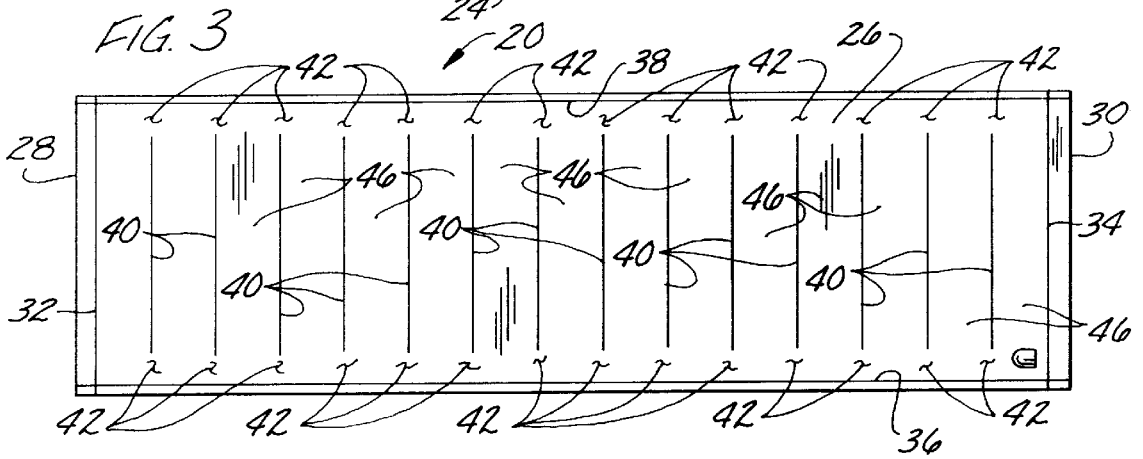
FIG. 3 is a bottom plan view of the mattress of FIG. 1, the mattress being in a deflated condition.
Figure 4:
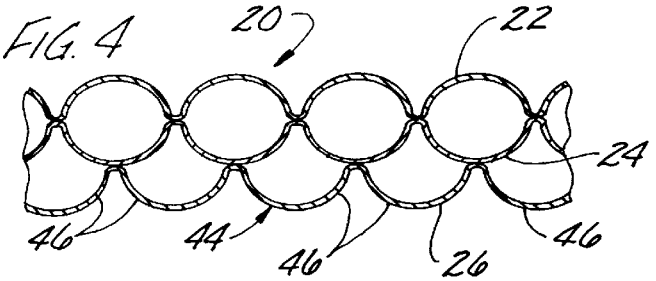
FIG. 4 is a cross-sectional view taken along the plane of line 4—4 of FIG. 1.

As shown in FIGS. 2 and 3, all three sheet layers 22, 24, 26 are joined together adjacent their head end edges via a first end seal line 32, adjacent their foot end edges via a second end seal line 34, and adjacent their side edges via first and second side seal lines 36, 38. Preferably, the first and second end seal lines extend continuously from the first side seal line 36 to the second side seal line 38, and the side seal lines extend continuously from the first end seal line 32 to the second end seal line 34. The seal lines 32, 34, 36, 38 provide a fluid tight seal between the upper and middle sheet layers 22, 24 and between the middle and lower sheet layers 24, 26, and define the periphery of the mattress 20.

As shown in FIG. 3, the middle and lower sheet layers 24, 26 are joined together along a plurality of lower heat seal lines 40 spaced at generally equal intervals between and parallel to the end seal lines 32, 34. Preferably, the lower heat seal lines 40 do not extend the entire width of the mattress 20. In other words, the lower heat seal lines 40 are spaced inwardly from the side seal lines 36, 38 to provide gaps 42 between the seal lines 40 and the side seal lines. The middle and lower sheet layers 24, 26 and the seal lines 32, 34, 36, 38, 40 define an inflatable air chamber, (FIG. 4) generally indicated at 44, having a plurality of generally tubular-shaped sub-chambers 46. Because the lower heat seal lines 40 do not extend the entire width of the mattress 20, the sub-chambers 46 are in fluid communication with each other via the gaps 42. An inlet nozzle 48 (FIG. 3) is secured to the lower sheet layer 26 and aligned with an inlet opening (not shown) through the lower sheet layer. The inlet nozzle 48 is connectable to a source of pressurized air, such as an air pump or compressor, to permit introduction of air through the inlet opening and into the air chamber 44.

AS shown in FIG. 2, the upper and middle sheet layers 22, 24 are joined together along a plurality of upper heat seal lines 50 spaced at generally equal intervals between and parallel to the end seal lines 32, 34, and parallel to the lower heat seal lines 40. Preferably, each upper heat seal line 50 is spaced longitudinally (i.e., to the left or right as viewed in FIGS. 2–4) from each of the lower heat seal lines 40 and extends continuously from the first side seal line 36 to the second side seal line 38. In particular, a corresponding upper heat seal line 50 is positioned generally midway between each pair of adjacent lower heat seal lines 40. The upper and middle sheet layers 22, 24 and the seal lines 32, 34, 36, 38 and 50 define a plurality of tubular-shaped inflatable mattress portions 52.

The middle sheet layer 24 includes a plurality of through feed openings 54 (FIG. 2), constituting fluid passageways providing fluid communication between the inflatable sub-chambers 46 and the inflatable mattress portions 52. Preferably, at least one feed opening 54 corresponds with each inflatable mattress portion 52 so that the mattress portions are inflated from air in the sub-chambers 46 via the feed openings. The upper sheet layer 22 includes a plurality of small ventilation holes 56 (eg., diameters of about 1/32") for ventilating air from the mattress portions 52 and to a patient laying on the mattress 20. Preferably, the upper sheet layer 22 includes at least three ventilation holes 56 for each mattress portion 52. Air introduced into the mattress 20 via the inlet nozzle 48 flows around the lower seal lines 40 to fill the sub-chambers, flows through the feed openings 54 in the middle sheet layer 24 to fill the mattress portions 52, and then flows out the ventilation holes 56.

Preferably, some of the feed openings 54 in the middle sheet layer 24 are larger or smaller than some of the other feed openings 54 so that air flows into some of the inflatable mattress portions 52 at different rates than in other mattress portions. In this manner, the mattress portions 52 may be inflated to different pressures. To provide optimal comfort to a patient, greater air pressure is generally needed to support a patient's torso than is need to support the patient's head or legs. Thus, the feed openings 54 corresponding to the mattress portions 52 near the head and leg regions of the mattress 20 are preferably smaller than the feed openings corresponding to the mattress portions near the middle region of the mattress. Preferably, the feed openings 54 vary in diameter from 1/8" to 5/8". However, it is to be understood that other size feed openings may be used without departing from the scope of this invention.

In operation, the mattress 20 is placed on a conventional hospital bed-frame (not shown) and the inlet nozzle 48 is connected to a source of pressurized air such as an electric air pump. Preferably, the mattress 20 includes a plurality of connector straps 58 (FIG. 1) for securing the mattress to the bed frame. Air is continuously pumped through the inlet nozzle 48 into the air chamber 44. Air flows from the air chamber 44 into the mattress portions 52 via the feed openings 54 and exits the mattress portions via the ventilation holes 56. If some of the feed openings 54 are larger than other feed openings, the mattress portions 52 corresponding to the larger feed openings will be maintained at greater inflation pressures than those of the other mattress portions. Because fluid communication between the air chamber 44 and the mattress portions 52 is provided by the feed openings 54 through the middle sheet 24, no tubing separate from the sheets is needed. Thus, a highly effective ventilation-type mattress may be made sole from three flat sheet layers. Also, because the upper heat seal lines 50 are spaced longitudinally from the lower heat seal lines 40 (i.e., from right to left as viewed in FIGS. 2 and 4), the upper heat seal lines are spaced above (i.e., at a higher elevation than) the lower heat seal lines when the mattress 20 is inflated. When inflated, therefore, the mattress 20 is thicker than it would be if the upper heat seal lines were aligned with the lower heat seal lines.

Figure 5:
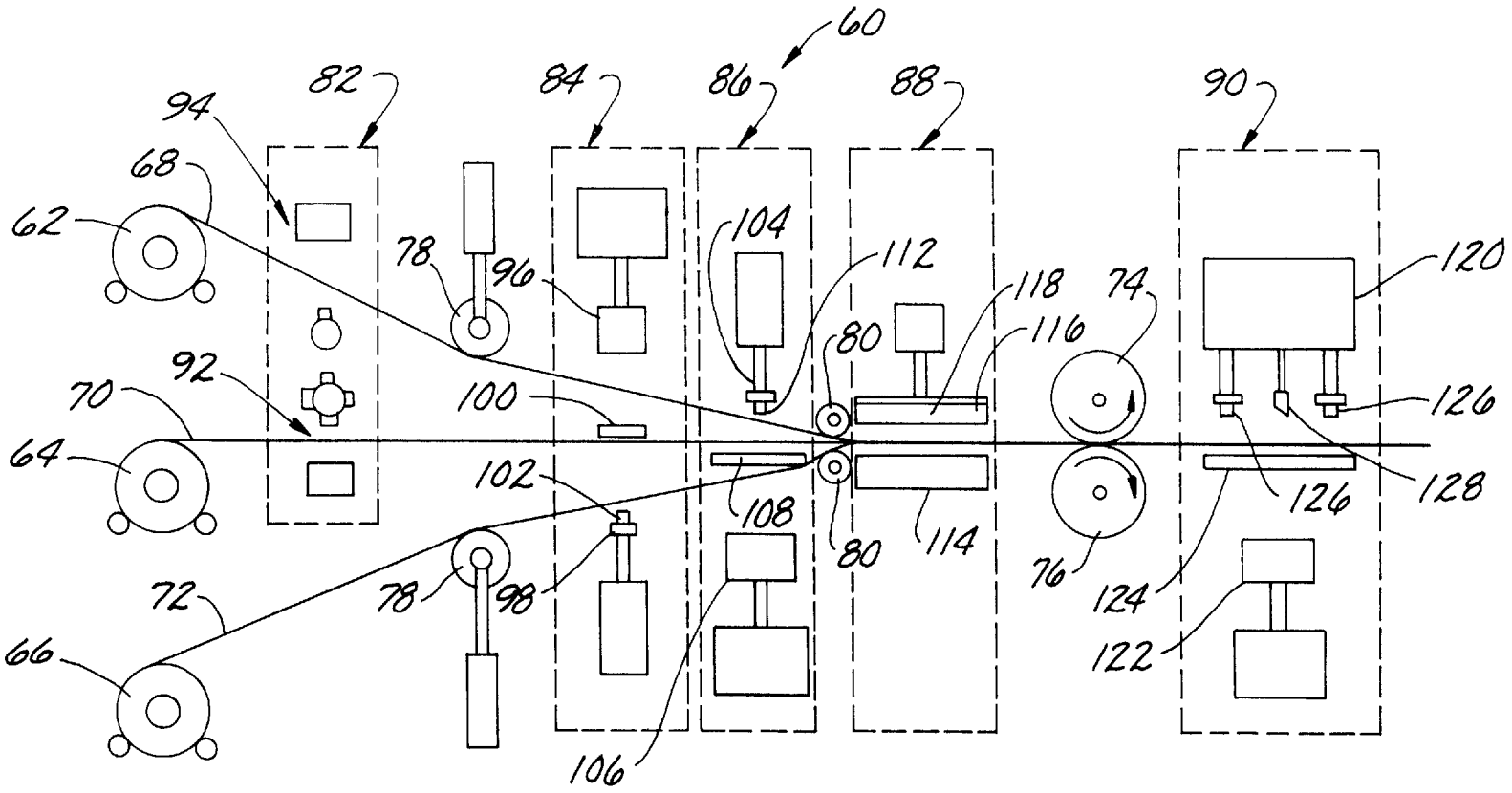
FIG. 5 is a schematic side elevational view of a mattress forming apparatus of the present invention for making mattresses of the present invention.
Figure 6:
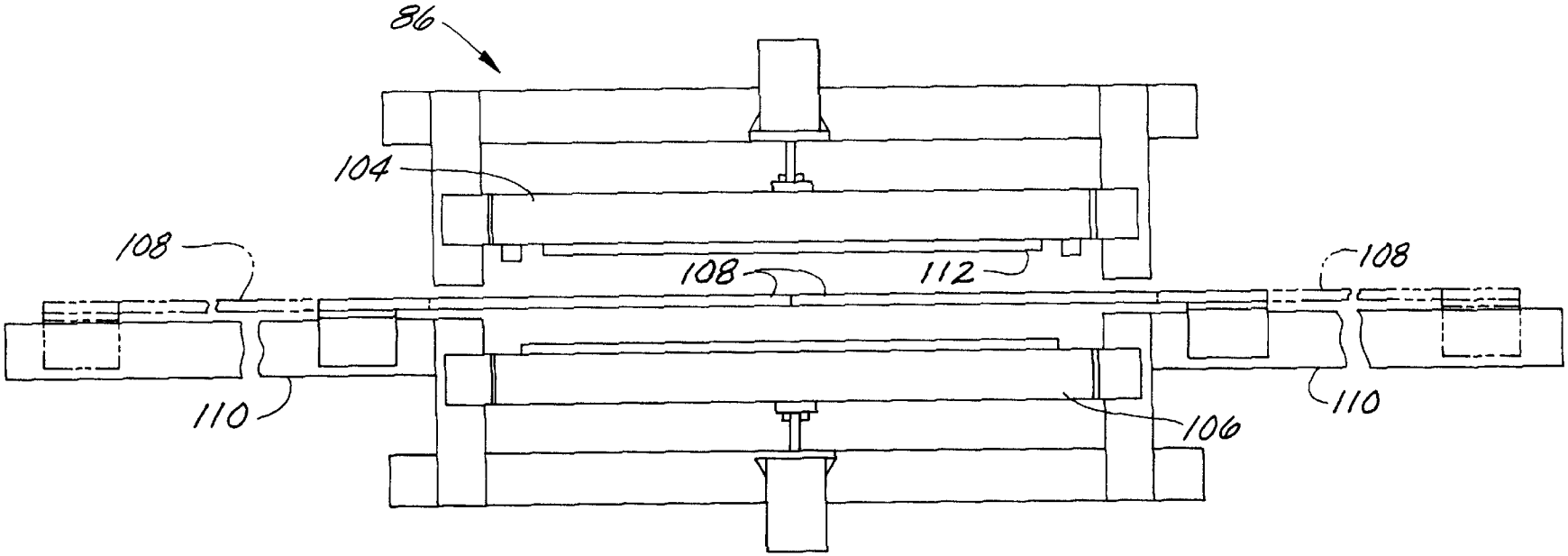
FIG. 6 is a schematic end elevational view of an upper weld station of the mattress forming apparatus of FIG. 5.

Referring now to FIGS. 5 and 6, a mattress forming apparatus for making the mattress 20 of FIGS. 1–4 is indicated in its entirety by the reference numeral 60. The apparatus 60, shown schematically in FIG. 5, includes upper, middle and lower rolls of polyethylene film 62, 64, 66. The rolls of film 62, 64, 66 are mounted on rollers to facilitate unrolling the sheets of film. Upper, middle, and lower sheet portions 68, 70, 72 are unrolled from the rolls so that they extend forward through the apparatus 60 and are pressed together at a forward (downstream) end of the apparatus via counter-rotating upper and lower draw rollers 74, 76. The upper draw roller 74 engages the upper sheet portion 68 and rotates in a counter-clockwise direction (as viewed in FIG. 5) while the lower draw roller 76 engages the lower sheet portion 72 and rotates in a clockwise direction to draw the sheet portions forward (i.e., from left to right as viewed in FIG. 5) through the apparatus 60. First and second pairs of guide rollers 78, 80 engage the upper and lower sheet portions 68, 72 to properly orient reaches of such sheet portions as the sheet portions are drawn through the apparatus.

The apparatus 60 includes a plurality of stations which are preferably operated generally simultaneously but on different regions of the sheet portions 68, 70, 72 to make the mattress. In particular, the apparatus 60 includes a hole punch station 82, a lower weld station 84 for forming the lower heat seal lines 40 of the mattress 20, an upper weld station 86 for forming the upper heat seal lines 50, a side weld station 88 for forming the first and second side seal lines 36, 38, and an end seal and cutting station 90 for forming the end seal lines 32, 34 and for cutting the sheets to separate adjacent mattresses. The mattress forming apparatus 60 further includes a controller (not shown). Preferably, the controller comprises a conventional processor, such as an Intel Pentium® processor for controlling operation of the draw rollers 74, 76, and the various stations of the mattress forming apparatus 60.

The hole punch station 82 includes a first hole punching mechanism 82 for forming the feed openings 54 in the middle sheet layer 24 and a second hole punching mechanism 94 for forming the ventilation holes 56 through the upper sheet layer 22. The first and second hole punching mechanisms 92, 94 may be of any conventional design capable of punching or cutting holes in plastic sheeting. Preferably, the first hole punching mechanism 92 is capable of selectively punching holes of different sizes in the middle sheet layer 24 to form feed openings 54 of different sizes. The controller determines the size of the hole to form depending upon the portion of the mattress being formed.

The lower weld station 84 comprises upper and lower press members 96, 98 and a spacer member 100 between the press members. The upper press member 96 is positioned above the upper sheet portion 68, the lower press member 98 is positioned below the lower sheet portion 72, and the spacer member 100 is positioned between the middle sheet portion 70 and upper sheet portion. The press members 96, 98 and spacer member 100 are elongate members extending width-ways with respect to the sheet portions 68, 70, 72, but are not as wide as the sheet portions. For example, the sheet portions preferably have a width of about 43" and the members 96, 98, 100 preferably have a width of about 27" so that when the lower heat seal lines 40 of the mattress 20 are formed, they are spaced several inches from the side edges of the sheet portions. The press members 96, 98 are moved up and down via pneumatic cylinders between unpressed positions (FIG. 5) in which the press members are vertically spaced from the spacer member 100, and pressed positions (not shown) in which the press members press the sheet portions against the spacer member. In particular, when the press members 96, 98 are in their pressed positions, the middle and lower sheet portions 70, 72 are pressed together between the lower press member and spacer member, and the spacer member prevents the upper sheet portion 68 from being pressed against the middle sheet portion. The lower press member 98 includes a heating element 102 preferably along the entire length of the press member for heat sealing the middle and lower sheet portions 70, 72 together to form the lower heat seal lines 40. The spacer member 100 preferably includes a thermal insulation layer made of a closed-cell silicone or other suitable material for insulating the upper sheet portion 68 from the heating element 102.

Referring to FIGS. 5 and 6, the upper weld station 86 comprises upper and lower press members 104, 106 and a pair of sliding spacer members 108 positionable between the press members. The upper press member 104 is positioned above the upper sheet portion 68, the lower press member 106 is positioned below the lower sheet portion 72, and the sliding spacer members 108 are positionable between the middle sheet portion 70 and the lower sheet portion 72. The press members 104, 106 are similar to the press members 96, 98 of the lower weld station 84 except the press members 104, 106 extend across the entire width of the sheet portions. As shown in FIG. 6, the sliding spacer members 108 are slidably mounted on outwardly extending rails 110 for movement between inner positions (shown in solid in FIG. 6) and outer positions (shown in phantom in FIG. 6). It is to be understood that during operation the sliding spacer members are preferably in their inner positions at the same time and in their outer positions at the same time. The sliding spacer members 108 may be moved between their inner and outer positions by any conventional means (not shown), such as rodless cylinders or belt drives.

The upper weld station 86 is used for forming the upper heat seal lines 50. The press members 104, 106 are moved up and down via pneumatic cylinders between unpressed positions (FIGS. 5 and 6) in which the press members are vertically spaced from the sliding spacer members 108, and pressed positions (not shown) in which the press members press the sheet portions against the sliding spacer members. In particular, when the sliding spacer members 108 are in their inner positions and when the press members 104, 106 are in their pressed positions, the upper and middle sheet portions 68, 70 are pressed together between the upper press member and the sliding spacer members, and the sliding spacer members prevent the lower sheet portion 72 from being pressed against the middle sheet portion. The upper press member 104 includes a heating element 112 preferably along the entire length of the press member for heat sealing the upper and middle sheet portions 68, 70 together to form the upper heat seal lines 50. Preferably, the press members 104, 106 and the sliding spacer members 108 are configured so that the upper heat seal lines 50 form a continuous bond across the entire width of the sheet portions 68, 70. The sliding spacer members 108 preferably include thermal insulation layers made of a closed-cell silicone or other suitable material for insulating the lower sheet portion 72 from the heating element 112.

The side weld station 88 includes two lower plates 114 (only one of which is shown in FIG. 5) engageable with opposite side edge margins of the lower sheet portion 72, and two side press members 116 (only one of which is shown in FIG. 5) engageable with the upper sheet portion 68. The side weld station 88 is used for forming the side seal lines 36, 38. The side press members 116 are moved up and down via pneumatic cylinders between unpressed positions (FIG. 5) in which the side press members are vertically spaced above the lower plates 114, and pressed positions (not shown) in which the side press members are moved downward to press the sheet portions 68, 70, 72 against the lower plates. The side press members 116 include heating elements 118 for heat sealing the upper, middle and lower sheet portions 68, 70, 72 together to form the side seal lines 36, 38.

The end seal/cutting station 90 is used for forming the end seal lines 32, 34, and for cutting the widths of the sheet portions 68, 70, 72 for separating adjacent mattresses. The end seal/cutting station includes upper and lower press members 120, 122, and a lower plate 124 between the press members. The press members 120, 124 are identical to the press members 104, 106 of the upper weld station 86. The press members 120, 122 of the end seal/cutting station are moved up and down via pneumatic cylinders between unpressed positions (FIG. 5) in which the press members are vertically spaced from the lower plate 124, and pressed positions (not shown) in which the sheet portions 68, 70, 72 are pressed between the upper press member 120 and the lower plate 124. The upper press member 120 includes a heating element 126 preferably along the entire length of the upper press member for heat sealing the upper, middle, and lower sheet portions 68, 70, 72 together to form the end seal lines 32, 34.

The end seal/cutting station further includes a cutting element 128 moveable up and down via a pneumatic cylinder. The cutting element may be a knife, a heated wire, or any other suitable cutting means capable of cutting through the three sheet portions.

To form mattresses with the apparatus 60, the sheet portions 68, 70, 72 are fed through the apparatus and between the draw rollers 74, 76. Preferably, the hole punch station 82, lower weld station 84, upper weld station 86, and side weld station 88 are operated simultaneously to simultaneously form the holes and heat seal lines. In particular, the hole punch station 82 forms three ventilation holes in the upper sheet portion 68 and forms one opening 54 through the middle sheet portion 70. Before the sheet portions are advanced (i.e., moved from left to right as viewed in FIG. 5), the lower weld station 84 forms one lower heat seal line 40, the upper weld station 86 forms one upper heat seal line 50, and the side weld station 88 forms small segments of the first and second side seal lines 36, 38. Next, the sliding spacer members 108 are moved to their outer positions, the draw rollers 74, 76 then advance the sheet portions a predetermined distance (e.g., 8") and then stop. These four stations are again operated to form three more ventilation holes 56, another opening 54, another lower heat seal line 40, another upper heat seal line 50, and two more segments of the first and second side seal lines 36, 38. These steps are repeated a predetermined number of times (e.g., fourteen times) to form the tubular-shaped sub-chambers 46 and the mattress portions 52. The end seal/cutting station 90 is then operated to form the end seal lines 32, 34 and to cut the sheet portions 68, 79, 72 along a line generally parallel to and between the first and second end seal lines.

It is to be understood that the end seal/cutting station 90 is operated only once for every several times the other stations are operated because there is only one first end seal line and only one second end seal line for every mattress. It is also to be understood that the first and second end seal lines simultaneously formed by the seal/cutting station 90 are for different mattresses. In other words, the first end seal line formed is for one mattress and the second end seal line simultaneously formed is for another adjacent mattress. Thus, the apparatus 60 may be operated to automatically make numerous mattresses 20.

Figure 7:
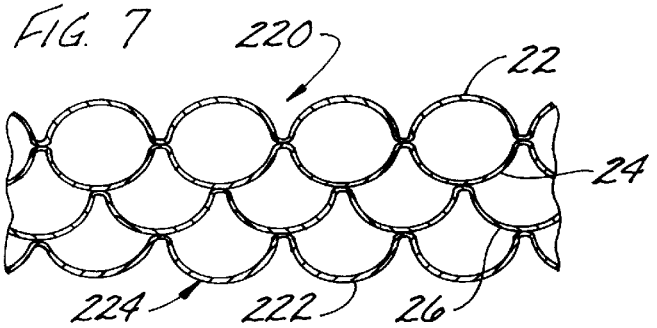
FIG. 7 is a cross-sectional view of another inflatable mattress of the present invention, the mattress being similar to the mattress of FIG. 4 but having a static air portion at its underside.

Referring now to FIG. 7, another inflatable mattress of the present invention is indicated in its entirety by the reference numeral 220. The mattress 220 is identical to the mattress 20 of FIGS. 1–4 except the mattress 220 further includes a fourth sheet layer 222 secured to the underside of the lower sheet layer 26. Thus, the description above with respect to FIGS. 1–4 is equally applicable to the mattress 220. The fourth sheet layer 222 and lower sheet layer 26 are bonded together in a manner to define an inflatable static air mattress portion 224 below the inflatable air chamber 44. The mattress 220, like the mattress 20 is configured to maintain inflation of the mattress portions 52 only upon continued introduction of air into the air chamber 44. However, the static air mattress portion 224 is configured to maintain inflation even upon termination of introduction of air into the air chamber. In particular, the fourth sheet layer 222 (also referred to as the second lower sheet layer) is heat sealed to the lower sheet layer 26 (also referred to as the first lower sheet layer) in substantially the same way the lower sheet layer is heat sealed to the middle sheet layer 24. However, there are no holes through the lower sheet layer 26 and therefore no fluid communication between the static air mattress portion 224 and the inflatable air chamber 44. The static air mattress portion 224 is inflatable independent of inflation of the air chamber 44 and the upper mattress portions 52. Because they are not in fluid communication with one another, the static air mattress portion 224 remains inflated even upon failure of the source of pressurized air to provide air to the inflatable air chamber 44. Thus, the mattress 220 is configured to maintain inflation of the static air mattress portion 224 even upon deflation of the air chamber 44. It is to be understood that the mattress 220 further includes a separate inflation/deflation valve (not shown) for introducing air into or removing air from the static air mattress portion 224.

It is also to be understood that the mattress making apparatus 60 could be modified to make mattresses 220. To make mattresses 220 as shown in FIG. 7, the mattress making apparatus would need to include another lower weld station. However, to enable the sheet portions to advance through the apparatus, at least one of the two weld stations would need to have sliding spacer members similar to the sliding spacer members 108 of the upper weld station 86 so that the spacer members can be moved out of the way after the corresponding heat seal lines are formed.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. An inflatable mattress comprising superposed lower, middle, and upper sheet layers, the lower and middle sheet layers being joined to each other in a manner to define an inflatable air chamber, the middle and upper sheet layers being secured to each other in a manner to define at least two independently inflatable mattress portions, fluid passageways providing fluid communication between the air chamber and the inflatable mattress portions, a plurality of ventilation apertures through the upper sheet layer for ventilating air from the inflatable mattress portions, said sheet layers being arranged such that air introduced into the inflatable air chamber flows through the fluid passageways into the inflatable mattress portions and then out through the ventilation apertures.

2. An inflatable mattress as set forth in claim 1 wherein the fluid passageways are defined by at least one of the lower, middle, and upper sheet layers.

3. An inflatable mattress as set forth in claim 2 wherein the fluid passageways are defined by apertures in one of the middle and lower sheet layers.

4. An inflatable mattress as set forth in claim 3 wherein the fluid passageways are defined by apertures in the middle sheet layer.

5. An inflatable mattress as set forth in claim 4 wherein the fluid passageways are configured for facilitating a greater air flow rate from the inflatable air chamber to one of the inflatable mattress portions than that from the inflatable air chamber to another of the inflatable mattress portions.

6. An inflatable mattress as set forth in claim 1 wherein the lower and middle sheet layers are attached together in a manner so that the air chamber comprises a plurality of generally tubular sub-chambers, said lower and middle sheet layers further being attached together in a manner so that the sub-chambers are in fluid communication with one another.

7. An inflatable mattress as set forth in claim 6 wherein said tubular sub-chambers are arranged in a side-by-side configuration.

8. An inflatable mattress as set forth in claim 7 wherein said inflatable mattress portions are generally tubular in shape.

9. An inflatable mattress as set forth in claim 1 wherein the lower sheet layer comprises a first lower sheet layer, said inflatable mattress further comprising a second lower sheet layer below the first lower sheet layer, said first and second lower sheet layers being attached together in a manner to define an inflatable static air mattress portion below the inflatable air chamber.

10. An inflatable mattress as set forth in claim 9 wherein upon inflation of said static air mattress portion, said mattress is configured to maintain inflation of said static air mattress portion even upon deflation of said air chamber.

11. An inflatable mattress as set forth in claim 9 further comprising a fill opening in fluid communication with said air chamber for introducing air into said air chamber, said mattress being configured to maintain inflation of the mattress portions only upon continued introduction of air into the air chamber, the static air mattress portion being configured to maintain inflation even upon termination of introduction of air into the air chamber.

12. A method of making an inflatable mattress having upper, middle, and lower sheet layers with each sheet layer having opposite upper and lower faces, the middle and lower sheets being joined together in a manner to define an inflatable air chamber, the upper and middle sheets being joined together in a manner to define at least one inflatable mattress portion, the method comprising:

positioning the upper, middle, and lower sheet layers in a generally face-to-face orientation so that the lower face of the upper sheet layer faces the upper face of the middle sheet layer and the lower face of the middle sheet layer faces the upper face of the lower sheet layer;

squeezing first regions of the middle and lower sheets together between first and second press elements, the first press element being in contact with the upper face of the middle sheet layer and the second press element being in contact with the lower face of the lower sheet layer;

heat sealing the first regions of the middle and lower sheets together as the first regions are squeezed together;

squeezing second regions of the upper and middle sheets together between third and fourth press elements, the third press element being in contact with the upper face of the upper sheet layer and the fourth press element being in contact with the lower face of the middle sheet layer; and heat sealing the second regions of the upper and middle sheets together as the second regions are squeezed together.

13. A method as set forth in claim 12 wherein the step of heat sealing the first regions together is performed simultaneously with the step of heat sealing the second regions together.

14. An inflatable mattress made by the method of claim 12.

* * * * *